US010011133B2

(12) United States Patent
Muto et al.

(10) Patent No.: US 10,011,133 B2
(45) Date of Patent: Jul. 3, 2018

(54) LIQUID DISCHARGE DEVICE, METHOD FOR CONTROLLING LIQUID DISCHARGE DEVICE, AND DEVICE DRIVER

(71) Applicant: Seiko Epson Corporation, Tokyo (JP)

(72) Inventors: Atsushi Muto, Shiojiri (JP); Ryosuke Tsuchihashi, Matsumoto (JP); Hiroshige Owaki, Okaya (JP); Nobuaki Azami, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/434,680

(22) Filed: Feb. 16, 2017

(65) Prior Publication Data

US 2017/0246893 A1 Aug. 31, 2017

(30) Foreign Application Priority Data

Feb. 26, 2016 (JP) ..... 2016-036139

(51) Int. Cl.
*B41J 29/377* (2006.01)
*B41J 2/045* (2006.01)
*B41J 2/14* (2006.01)

(52) U.S. Cl.
CPC ..... *B41J 29/377* (2013.01); *B41J 2/04541* (2013.01); *B41J 2/04553* (2013.01); *B41J 2/04581* (2013.01); *B41J 2/04588* (2013.01); *B41J 2/14233* (2013.01); *B41J 2002/14241* (2013.01); *B41J 2002/14475* (2013.01); *B41J 2202/11* (2013.01)

(58) Field of Classification Search
CPC ..... B41J 2/04541; B41J 2/04581; B41J 2/04553; B41J 2/04588; B41J 2/14233; B41J 2202/11; B41J 2002/14475; B41J 2002/14241; B41J 2/161; B41J 2/162; B41J 2/1626; B41J 2/1631; B41J 2/16; B41J 2/14064; B41J 2/175
See application file for complete search history.

(56) References Cited

U.S. PATENT DOCUMENTS

2010/0134560 A1* 6/2010 Doi ..... B41J 2/14064 347/47

FOREIGN PATENT DOCUMENTS

JP 2007272680 * 4/2013 ..... B41J 2/175
JP 2015-223768 A 12/2015
WO WO-2008-155986 A1 12/2008

* cited by examiner

*Primary Examiner* — Kristal Feggins
(74) *Attorney, Agent, or Firm* — Harness, Dickey & Pierce, P.L.C.

(57) ABSTRACT

A liquid discharge device includes a liquid discharge head that includes a nozzle from which liquid is discharged and a liquid channel communicating with the nozzle, and that discharges liquid from the nozzle. The nozzle has an inner wall surface having an uneven pattern including a recess where the inner diameter of the nozzle is increased and a projection where the inner diameter of the nozzle is smaller than that in the recess. In a case where ink is continuously discharged from an identical nozzle, at a time when a meniscus in the nozzle after previous discharge is located closer to an initial position before discharge than a center position between the initial position and a position at which the meniscus is most greatly drawn toward the liquid channel, subsequent discharge is performed.

13 Claims, 11 Drawing Sheets

FIG. 12

| DRIVING FREQUENCY [kHz] | 36 | 38 | 40 | 42 | 44 | 46 | 48 | 50 |
|---|---|---|---|---|---|---|---|---|
| IMAGE QUALITY DEGRADATION | ○ | ○ | ○ | ○ | × | × | × | × |
| INTERMITTENT PERFORMANCE | × | ○ | ○ | ○ | ○ | ○ | ○ | ○ |

LIQUID DISCHARGE DEVICE, METHOD FOR CONTROLLING LIQUID DISCHARGE DEVICE, AND DEVICE DRIVER

BACKGROUND

1. Technical Field

The present invention relates to liquid discharge device such as an ink jet recording apparatus, a method for controlling a liquid discharge device, and a device driver, and particularly to a liquid discharge device that discharges liquid from a nozzle by driving a driver element to cause pressure vibrations of liquid in a liquid channel, a method for controlling such a liquid discharge device, and a device driver.

2. Related Art

A liquid discharge device includes a liquid discharge head having a nozzle from which various types of liquid are discharged (ejected). Such a liquid discharge device is exemplified by an image recording device such as an ink jet printer or an ink jet plotter, and has been applied to various types of manufacturing apparatuses by utilizing a feature of causing a very small amount of liquid to impact a predetermined location accurately. Specifically, the liquid discharge device is applied to, for example, display manufacturing apparatuses for manufacturing color filters of liquid crystal displays and the like, electrode formation apparatuses for forming electrodes of organic electro luminescence (EL) displays and field emission displays (FEDs), and chip manufacturing apparatuses for manufacturing biochips. A recording head for an image recording device discharges liquid ink. A coloring material discharging head for a display manufacturing apparatus discharges solutions of coloring materials of red (R), green (G), and blue (B) from nozzles. An electrode material discharging head for an electrode formation apparatus discharges a liquid electrode material. A biogenic organic substance discharging head for a chip manufacturing apparatus discharges a solution of a biogenic organic substance.

In a printer, which is a type of the liquid discharge device, anisotropic etching and formation of a side wall protection film are alternately repeated on a silicon substrate (so-called a Bosch process) so that a nozzle having a circular orifice is formed (see, for example, International Publication No. WO 2008/155986). This technique enables formation of nozzles having smaller sizes with accurately uniformized dimensions and shapes. Inner wall surfaces of the thus-formed nozzles have wave-shaped patterns called scallops. These scallops form a wave-shaped uneven pattern on the inner peripheral surface of a nozzle in cross section formed because annular recesses (recesses) each extending along the circumference of the nozzle are arranged along the center axis of the nozzle. In the case of ejecting liquid including a solid component from a nozzle having such scallops, the following problems arise. That is, while the liquid is stabilized before ejection of liquid, the surface (meniscus) of liquid in the nozzle is located near an opening (an opening toward the outside) of the nozzle. In a liquid discharge operation by driving of a driver element, pressure variations occur in a liquid channel so that the liquid surface is drawn into the nozzle (toward the liquid channel) or pushed toward the outside of the nozzle. In the configuration having an uneven pattern on the inner wall surface of the nozzle as described above, liquid is likely to remain in the recesses, and liquid in the recesses is exposed to outside air when the meniscus is drawn into the nozzle so that the viscosity of liquid gradually increases and a sediment of a solid component of the liquid is attached to the inner wall surface of the nozzle. The sediment on the inner wall surface near the opening of the nozzle causes a flying direction of liquid droplets discharged from the nozzle to be deviated from an intended direction so that the impact location on a target of liquid droplets is shifted from an originally intended location. Such a deviation of the impact location of liquid droplets causes, for example, degradation of quality of a recorded image in the case of recording an image or the like on an impact target.

SUMMARY

Regarding the uneven pattern on the inner peripheral surface of the nozzle, the etching rate may be reduced to reduce a level difference of the uneven pattern and, thereby, smooth the uneven pattern. In this case, however, the number and time of processes increase accordingly, resulting in a problem of lower productivity.

An advantage of some aspects of the invention is to provide a liquid discharge device capable of reducing a liquid discharge failure caused by attachment of a solid component in liquid to an uneven portion of a nozzle inner wall surface, a method for controlling such a liquid discharge device, and a device driver.

According to a first aspect of the invention, a liquid discharge device includes a liquid discharge head that includes a nozzle from which liquid is discharged and a liquid channel communicating with the nozzle, and that discharges liquid from the nozzle, wherein the nozzle has an inner wall surface having one or more annular recesses each of which extends along a circumference of the nozzle and which are arranged along a center axis of the nozzle so that the inner wall surface has an uneven pattern, and in a case where ink is continuously discharged from an identical nozzle, at a time when a meniscus in the nozzle after previous discharge is located closer to an initial position before discharge than a center position between the initial position and a position at which the meniscus is most greatly drawn toward the liquid channel, subsequent discharge is performed.

With this configuration, in the case of continuously discharging ink from the identical nozzle, ink is repeatedly discharged in the state where the meniscus in the nozzle is located closer to the initial position so that drawing of the meniscus is reduced, and accordingly, a period in which liquid remaining in the inner wall of the nozzle is exposed to outdoor air is reduced. Consequently, sediment caused by a solid component of liquid is less likely to be generated near an opening of the nozzle. As a result, flexure in the flying direction of liquid droplets is reduced.

In the above configuration, the liquid discharge device preferably further includes: a driver element that causes a pressure vibration of liquid in the liquid channel and causes the liquid to be discharged from the nozzle; a driving pulse generator that generates a driving pulse for driving the driver element; and a detection mechanism that detects environment information, wherein the driving pulse generator reduces an occurrence frequency of the driving pulse depending on environment information detected by the detection mechanism.

With this configuration, the occurrence frequency of the driving pulse is reduced in an environment where there is a risk of attachment of sediment to the inner wall surface of the nozzle. Thus, the time from previous discharge to subsequent discharge is extended so that ink can be discharged in a state where the meniscus in the nozzle is closer to the initial position accordingly. This can effectively reduce generation of sediment in the nozzle.

In the above configuration, the environment information may be temperatures, and if a temperature detected by the detection mechanism is lower than a predetermined threshold, the driving pulse generator may set the occurrence frequency of the driving pulse at a maximum occurrence frequency in specification, whereas if the temperature detected by the detection mechanism is the predetermined threshold or more, the driving pulse generator may set the occurrence frequency of the driving pulse lower than the maximum occurrence frequency.

With this configuration, the occurrence frequency of the driving pulse is set at the maximum occurrence frequency in specification in the environment where the temperature is lower than the threshold. Thus, a throughput of a liquid droplet discharge operation can be enhanced, and accordingly, a discharge failure of liquid droplets due to an increase in the viscosity of liquid in the liquid droplet discharge operation can be reduced. On the other hand, the occurrence frequency of the driving pulse is reduced in the environment where the temperature is the threshold or more. Thus, the time from previous discharge to subsequent discharge is extended so that ink can be discharged in a state where the meniscus in the nozzle is closer to the initial position accordingly. This can effectively reduce generation of sediment in the nozzle.

In the above configuration, the environment information may be humidities, and if a humidity detected by the detection mechanism is higher than a predetermined threshold, the driving pulse generator may set the occurrence frequency of the driving pulse at a maximum occurrence frequency in specification, whereas if the humidity detected by the detection mechanism is the predetermined threshold or less, the driving pulse generator may set the occurrence frequency of the driving pulse lower than the maximum occurrence frequency.

With this configuration, the occurrence frequency of the driving pulse is set at the maximum occurrence frequency in specification in the environment where the humidity is higher than the threshold. Thus, a throughput of a liquid droplet discharge operation can be enhanced, and accordingly, a discharge failure of liquid droplets due to an increase in the viscosity of liquid in the liquid droplet discharge operation can be reduced. On the other hand, the occurrence frequency of the driving pulse is reduced in the environment where the humidity is the threshold or less. Thus, the time from previous discharge to subsequent discharge is extended so that ink can be discharged in a state where the meniscus in the nozzle is closer to the initial position accordingly. This can effectively reduce generation of sediment in the nozzle.

In the above configuration, the driving pulse generator preferably changes the occurrence frequency of the driving pulse to a range from 38 [kHz] or more to 42 [kHz] or less.

With this configuration, a significant decrease of a throughput of the liquid droplet discharge operation caused by the reduction of the pulse occurrence frequency can be reduced while flexure of the flying direction of liquid droplets caused by sediment in the nozzle is suppressed. In addition, a discharge failure of liquid droplets due to an increase in the viscosity of liquid in the nozzle during the liquid droplet discharge operation can be reduced.

In the above configuration, the liquid discharge device may further include a controller that causes a display device to display a selection screen for enabling a user to select a lower limit of the occurrence frequency in reducing the occurrence frequency of the driving pulse, and that receives selection by the user through the selection screen, wherein the driving pulse generator may change the occurrence frequency in a range not lower than the lower limit selected by the user.

With this configuration, the lower limit of the occurrence frequency of the driving pulse is selected and set by the user so that a liquid droplet discharge operation satisfying the needs of the user can be performed.

In the above configuration, the liquid discharge device may further include a controller that causes a display device to display a selection screen for enabling a user to select one of a first mode in which a liquid droplet discharge operation is performed with the occurrence frequency of the driving pulse reduced depending on the environment information and a second mode in which a liquid droplet discharge operation is performed with the occurrence frequency of the driving pulse unchanged, and that receives selection by the user through the selection screen, wherein the driving pulse generator may set the occurrence frequency of the driving pulse based on the selection by the user.

With this configuration, the user can easily and intuitively select a mode so that a liquid droplet discharge operation satisfying the needs of the user can be performed.

According to a second aspect of the invention, a method for controlling the liquid discharge device according to the first aspect of the invention includes: a selection screen display step of causing the display device to display the selection screen; a selection receiving step of receiving selection by a user through the selection screen; and a frequency setting step of setting the occurrence frequency of the driving pulse based on the selection by the user.

A device driver according to a third aspect of the invention is a device driver capable of being executed by an information processor connected to a liquid discharge device so that the information processor and the liquid discharge device can communicate with each other, wherein the device driver performs the steps of the method for controlling the liquid discharge device described above.

BRIEF DESCRIPTION OF THE DRAWINGS

The invention will be described with reference to the accompanying drawings, wherein like numbers reference like elements.

FIG. 12 is a table showing quality degradation of a recorded image and an acceptance determination of intermittent performance when a driving frequency is changed.

DESCRIPTION OF EXEMPLARY EMBODIMENTS

Embodiments of the present invention will be described hereinafter with reference to the attached drawings. In the following embodiments, various limitations are described as preferred examples of the invention.

The range of the invention, however, is not limited to the examples unless otherwise specified in the following description. In the following description, an ink jet recording apparatus (hereinafter referred to as a printer) will be described as an example of a liquid discharge device according to the invention.

Figure 1:
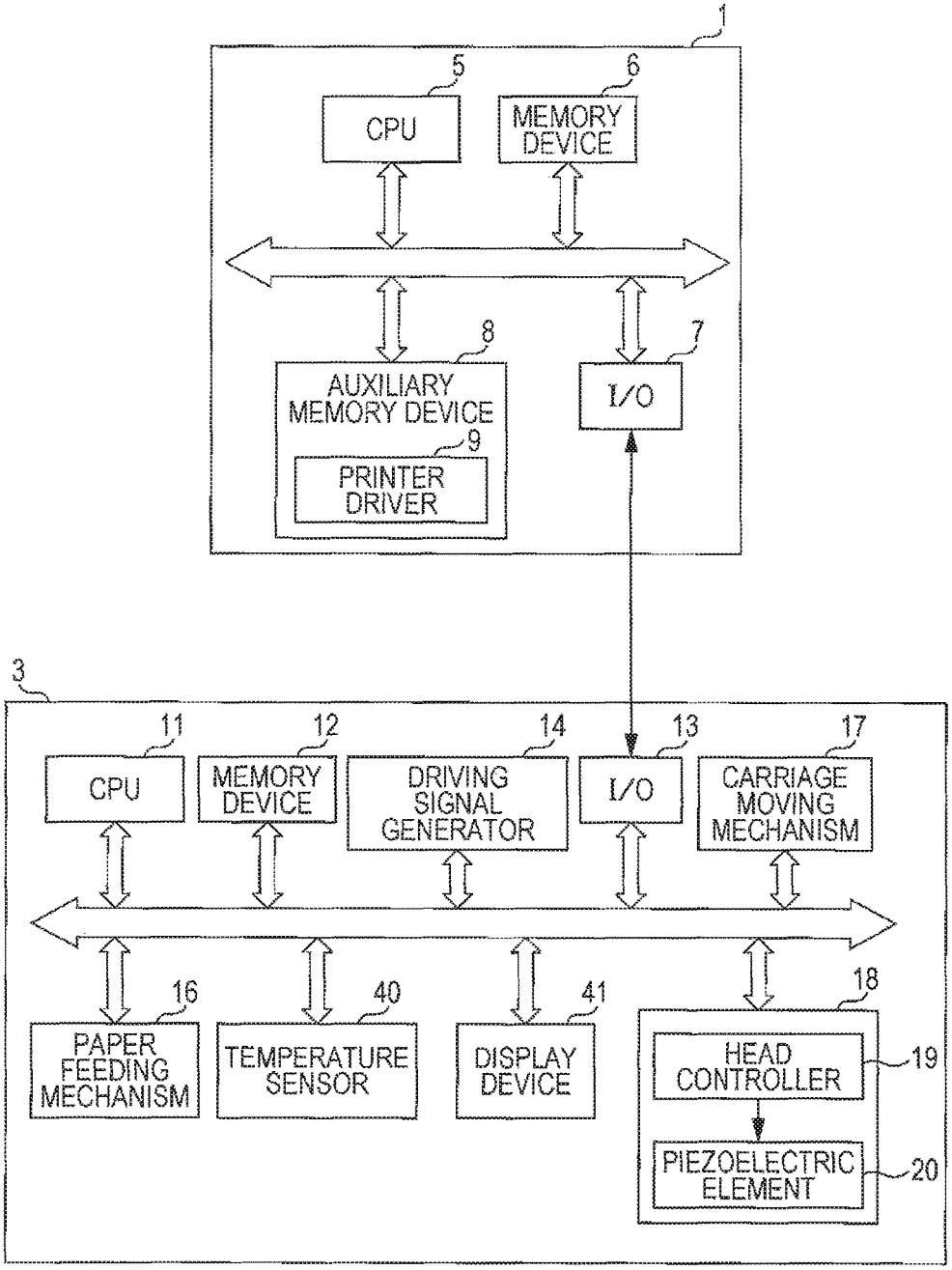
FIG. 1 is a block diagram illustrating a configuration of a print system.

FIG. 1 is a block diagram illustrating a print system including a printer according to the invention. The print system is configured in such a manner that an information processor such as a computer 1 or portable terminal equipment and a printer 3 are connected to each other wirelessly or by wires to communicate with each other. The computer 1 includes, for example, a CPU 5, a memory device 6, an input/output interface (I/O) 7, and an auxiliary memory device 8 which are connected to one another through an internal bus. The auxiliary memory device 8 is constituted by, for example, a memory device such as a server connected through a hard disk drive or a network, and stores, for example, an operation program, various application programs, and a printer driver 9 (a device driver according to the invention or a type of a controller according to the invention). The CPU 5 performs various processes such as execution of an application program and the printer driver 9, in accordance with an operation system stored in the auxiliary memory device 8. The input/output interface 7 is, for example, an interface such as a USB, and is connected to an input/output interface 13 of the printer 3 to output, to the printer 3, a request for recording generated by the printer driver 9 or data on printing, for example. The printer driver 9 is a program for performing a process of converting image data (e.g., image data or text data) generated by an application program to dot pattern data (also called raster data) for use in the printer 3 and various print settings, for example. The process of the printer driver 9 will be described later.

The printer 3 according to this embodiment includes a CPU 11 (a type of a controller according to the invention), a memory device 12, an input/output interface 13, a driving signal generator 14 (a type of a driving pulse generator according to the invention), a paper feeding mechanism 16, a carriage moving mechanism 17, a temperature sensor 40 (a type of a detection mechanism according to the invention) that detects a temperature near a recording head 18, a display device 41 such as a liquid crystal display device, and the recording head 18, for example.

The input/output interface 13 performs transmission and reception of various types of data, specifically receives a request for execution of printing or data on printing from the computer 1 and outputs status information of the printer 3 to the computer 1. The CPU 11 is an arithmetic processing unit for controlling the entire printer. The memory device 12 is a device for storing a program of the CPU 11 and data for use in various controls, and includes a ROM, a RAM, and a non-volatile random access memory (NVRAM). The CPU 11 controls units in accordance with programs stored in the memory device 12. The CPU 11 according to this embodiment transmits dot pattern data from the computer 1 to a head controller 19 of the recording head 18. The driving signal generator 14 generates an analog signal and amplifies the signal to generate a driving signal illustrated in FIG. 5, based on waveform data concerning a waveform of a driving signal. The head controller 19 performs control of selectively applying a driving pulse in the driving signal generated by the driving signal generator 14 based on the dot pattern data to each piezoelectric element 20. The connecting method between the printer 3 and the computer 1 is not limited to the method described here, and various connecting methods may be employed.

Figure 2:
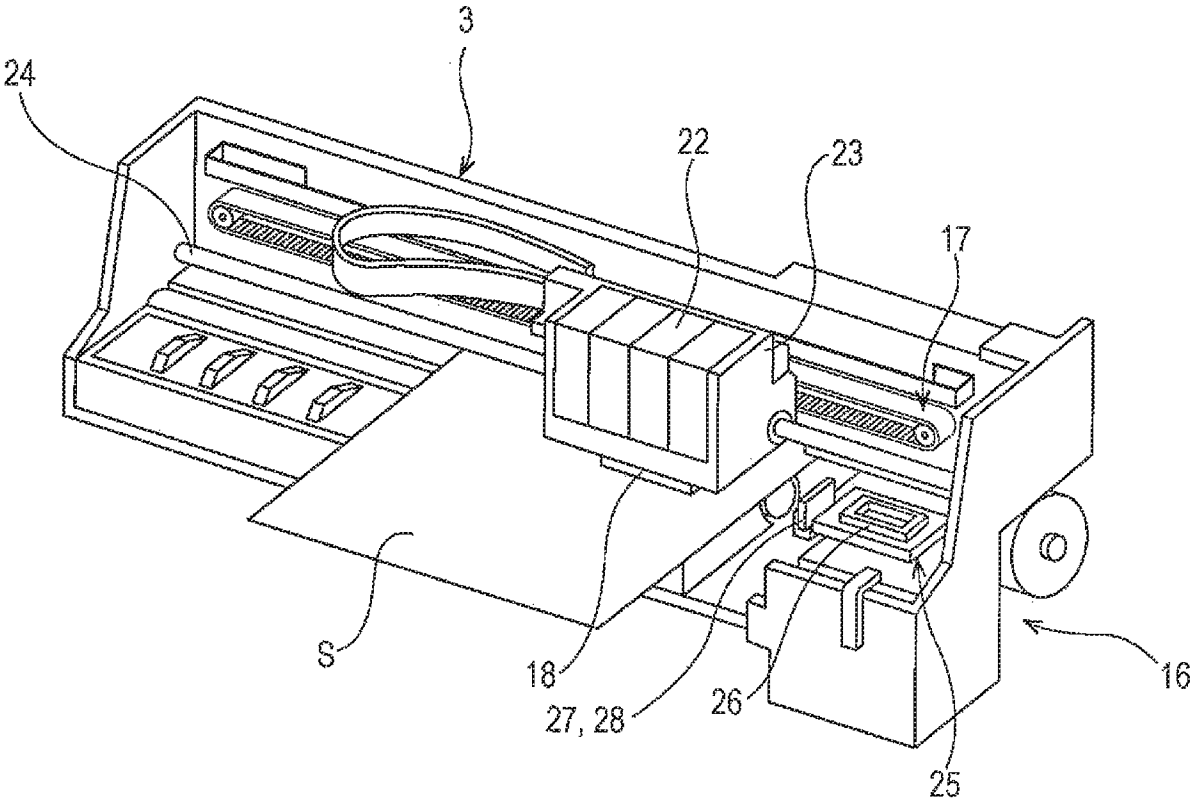
FIG. 2 is a perspective view illustrating an internal configuration of a printer.

FIG. 2 is a perspective view illustrating a configuration of the printer 3. In the printer 3 according to this embodiment, the recording head 18 is attached to a bottom surface of a carriage 23 carrying an ink cartridge 22. The carriage 23 is configured to reciprocate along a guide rod 24 by the carriage moving mechanism 17. Specifically, the printer 3 sequentially transports a recording medium S (impact target of a liquid droplet) such as a recording sheet by the paper feeding mechanism 16, and discharges ink from a nozzle 37 (see, for example, FIG. 3) of the recording head 18 while moving the recording head 18 in a width direction of the recording medium S (main scanning direction) relative to the recording medium, thereby causing the ink to impact on the recording medium S and recording an image, for example. A configuration in which the ink cartridge 22 is disposed in a body of the printer so that ink of the ink cartridge 22 is sent to the recording head 18 through a supply tube may be employed.

An end of the carriage 23 in a scanning direction (i.e., front at the right in FIG. 2) serves as a home position, and a capping mechanism 25 capable of sealing a nozzle surface of the recording head 18 is disposed below the home position. The capping mechanism 25 includes a cap 26 of a tray-shaped elastic material whose upper surface is open, and an unillustrated pump for generating a negative pressure in internal space of the gap 26 whose nozzle surface is sealed. The capping mechanism 25 is configured to move up and down by an unillustrated up-and-down mechanism, and is switchable between a sealing state in which the cap 26 seals the nozzle surface of the recording head 18 and a standby state in which the cap 26 is separated from the nozzle surface. In a maintenance operation (cleaning operation) in which ink with an increased viscosity or bubbles, for example, in the channel of the recording head 18 are removed to eliminate clogging or the like of the nozzle 37, the pump is actuated in the capping state to generate a negative pressure in internal space of the cap 26 so that ink or bubbles are forcedly discharged from the nozzle. The waste ink discharged to the cap 26 is discharged to an unillustrated waste ink tank.

A wiping mechanism 27 is disposed adjacent to the capping mechanism 25. The wiping mechanism 27 is used for wiping a nozzle surface of the recording head 18 with a wiper 28, and is configured to move the wiper 28 to a state in which the wiper 28 is in contact with the nozzle surface or a standby state in which the wiper 28 is separated from the nozzle surface. In this embodiment, the recording head 18 moves in the main scanning direction with the wiper 28 being in contact with the nozzle surface so that the wiper 28 slides on the nozzle surface to wipe the nozzle surface. A configuration in which the wiper 28 runs by itself while movement of the recording head 18 stops to, thereby, wipe the nozzle surface may be employed. That is, the recording head 18 and the wiper 28 only need to move relatively to each other to wipe the nozzle surface.

Figure 3:
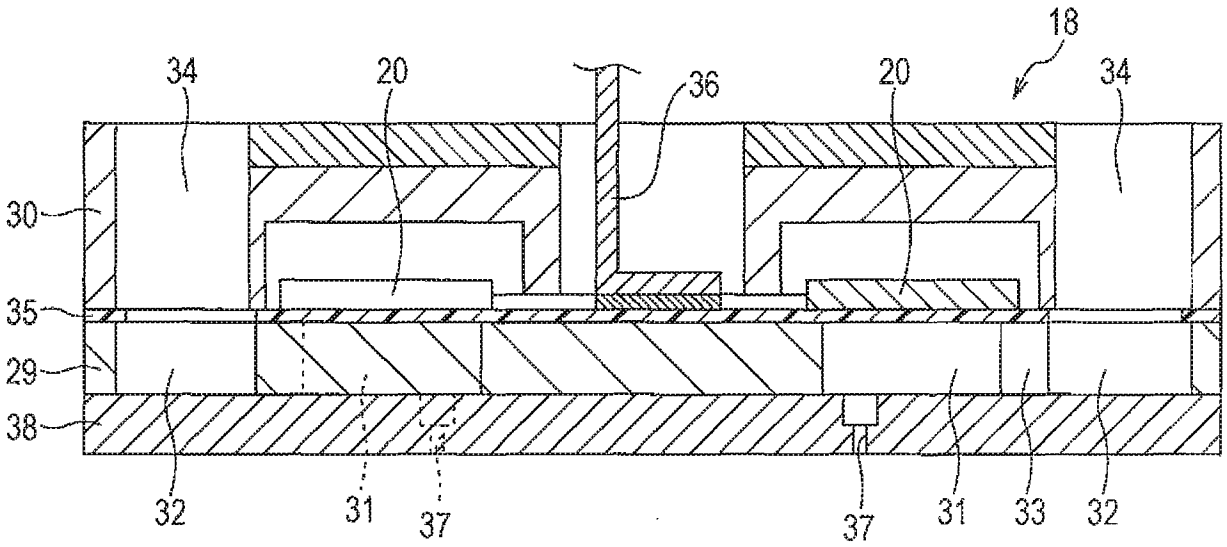
FIG. 3 is a cross-sectional view illustrating a configuration of a recording head.

FIG. 3 is a cross-sectional view illustrating a main portion of an internal configuration of the recording head 18.

The recording head 18 according to this embodiment is generally constituted by a nozzle plate 38, a channel substrate 29, and a piezoelectric element 20, for example, and is attached to a holder 30 with these components being stacked. The nozzle plate 38 is made of a silicon single crystal substrate in which a plurality of nozzles 37 are formed at a predetermined pitch and linearly extend in the same direction. In this embodiment, the parallel nozzles 37 constitute a nozzle series. A surface of the nozzle plate 38 from which ink is discharged corresponds to the nozzle surface of the recording head 18.

Figure 4:
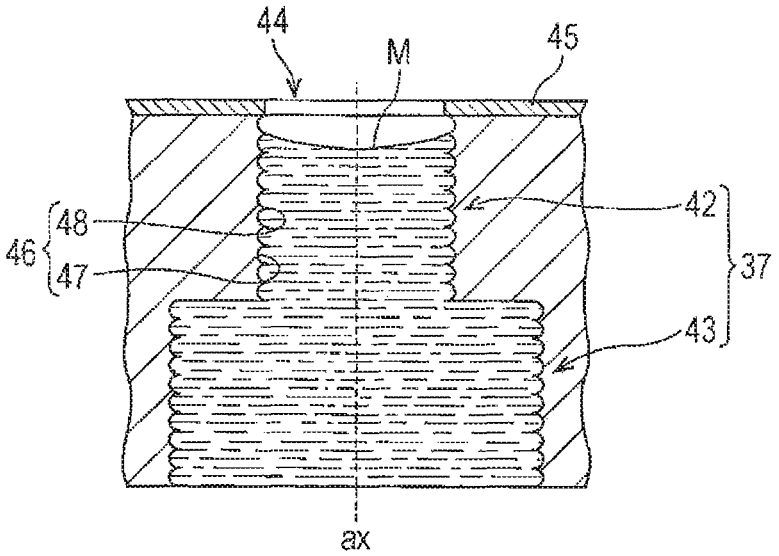
FIG. 4 is a cross-sectional view illustrating a configuration of a nozzle.

FIG. 4 is a cross-sectional view illustrating a configuration of the nozzle 37. The nozzle 37 according to this embodiment has a two-stage structure including a first nozzle portion 42 having a relatively small average inner diameter and a second nozzle portion 43 having a relatively large average inner diameter. An opening of the first nozzle portion 42 opposite to the second nozzle portion 43 is a nozzle opening 44 from which ink droplets (a type of liquid droplets) are discharged. A portion indicated by M in FIG. 4 is a meniscus that is the surface of ink in the nozzle 37. A liquid-repellent film 45 is formed on the surface of the nozzle plate 38 having the nozzle opening 44. The inner wall surface of each of the first nozzle portion 42 and the second nozzle portion 43 has one or more annular grooves (recesses 47) each of which extends along the circumference of the nozzle 37 and which are arranged along a center axis (virtual center axis) ax of the nozzle 37, thereby forming scallops (uneven pattern 46). Specifically, projections (projecting rings) 48 each projecting from the inner wall surface of the nozzle 37 toward the center axis ax and recesses (recessed rings) 47 each sandwiched between adjacent ones of the projections 48 are alternately arranged along the center axis ax so that an uneven pattern 46 that is a wave pattern (bellow pattern) in cross section is formed on the inner wall surface of the nozzle 37. The recesses 47 correspond to the bottoms of the wave pattern, where the inner diameters of the nozzle 37 (cross-sectional area in a direction orthogonal to the center axis ax) is increased. On the other hand, the projections 48 correspond to vertexes of the wave pattern, have inner diameters smaller than inner diameter (cross sections) of the bottoms (portions farthest from the center axis ax) of the recesses 47. Such an uneven pattern is formed in a process in forming the nozzle 37, specifically machining (Bosch process or ASE process) in which anisotropic etching and sedimentation (formation of a side wall protection film) are alternately performed. The method for processing the nozzle 37 is well known to the public, and thus, detailed description thereof is omitted. The shape of the nozzle 37 is not limited to the example illustrated in this embodiment. Except for the change in the inner diameter of the uneven pattern 46, the nozzle 37 may have a cylindrical shape having a uniform inner diameter or a multi-stage structure having three or more stages. The nozzle 37 may have a multi-stage structure having a tapered shape in which an inner wall surface is tilted in such a manner that the inner diameter of a nozzle portion closest to a pressure chamber gradually increases from a portion corresponding to a nozzle portion closest to the nozzle opening toward the opposite end. That is, in the invention, a nozzle having an inner wall surface with the uneven pattern described above is employed.

The channel substrate 29 has a plurality of cavities serving pressure chambers 31 and individually associated with the nozzles 37. A common liquid chamber 32 common to the pressure chambers 31 is formed outside the series of the pressure chamber 31 in the channel substrate 29. The common liquid chamber 32 communicates with the pressure chambers 31 through ink supply ports 33. The pressure chambers 31 and the ink supply ports 33 individually communicating with the nozzles 37 correspond to a liquid channel according to the invention. Ink is introduced from the ink cartridge 22 to the common liquid chamber 32 through an ink introduction path 34 of the holder 30. The piezoelectric element 20 (a type of a driver element) is disposed on the upper surface of the channel substrate 29 opposite to the nozzle plate 38 with an elastic film 35 interposed therebetween. The piezoelectric element 20 is formed by sequentially stacking a metal lower electrode film, a piezoelectric layer of, for example, lead zirconate titanate, and a metal upper electrode film (which are not shown). The piezoelectric element 20 is a so-called flexure mode piezoelectric element, and covers the pressure chamber 31 from above. The piezoelectric element 20 is deformed by applying a driving signal (driving pulse Pd (see FIG. 5)) through an interconnection member 36. In this manner, pressure variations occur in ink in the pressure chamber 31 corresponding to this piezoelectric element 20. These pressure variations of ink are controlled so that ink is discharged from the nozzle 37.

Figure 5:
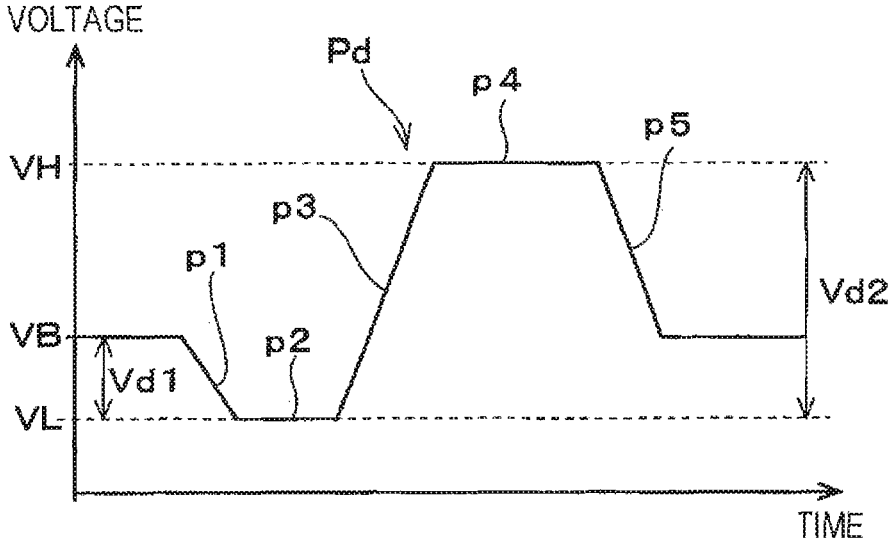
FIG. 5 is a waveform chart illustrating a configuration of a driving pulse.

FIG. 5 is a waveform chart illustrating an example of a driving pulse Pd generated by the driving signal generator 14. The driving pulse Pd in this embodiment includes an expansion element p1, an expansion hold element p2, a contraction element p3, a contraction hold element p4, and a restore element p5. The expansion element p1 is a waveform element whose potential drops from a reference potential VB to an expansion potential VL. The expansion hold element p2 is a waveform element that maintains the expansion potential VL that is a terminal end potential of expansion element p1 for a certain time. The contraction element p3 is a waveform element whose potential rises relatively steeply from the expansion potential VL to a contraction potential VH across the reference potential VB. The contraction hold element p4 is a waveform element that maintains the contraction potential VH for a predetermined time. The restore element p5 is a waveform element whose potential drops from the contraction potential VH to the reference potential VB to be restored. Here, a potential difference Vd1 (potential difference between the reference potential VB and the expansion potential VL) of the expansion element p1 is set to be sufficiently smaller than a potential difference Vd2 (potential difference between the contraction potential VH and the expansion potential VL) of the contraction element p3 (e.g., Vd1<Vd2/2). This is for the purpose of reducing the amount of drawing of the meniscus by the expansion element p1.

Figure 6:
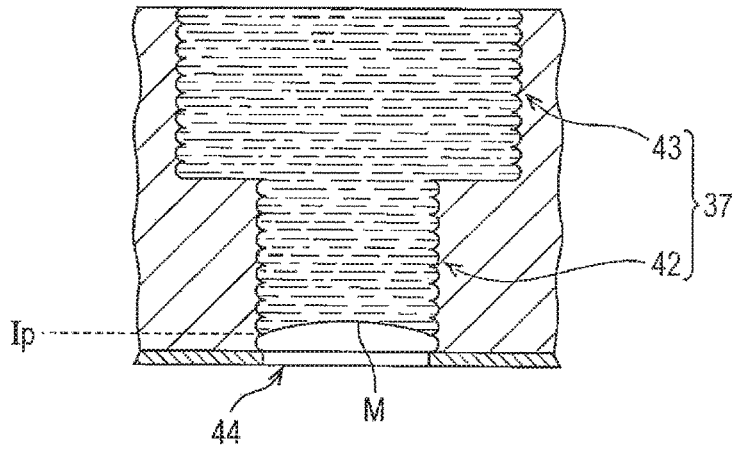
FIG. 6 is a view illustrating a process in which a liquid droplet is discharged from the nozzle.
Figure 7:
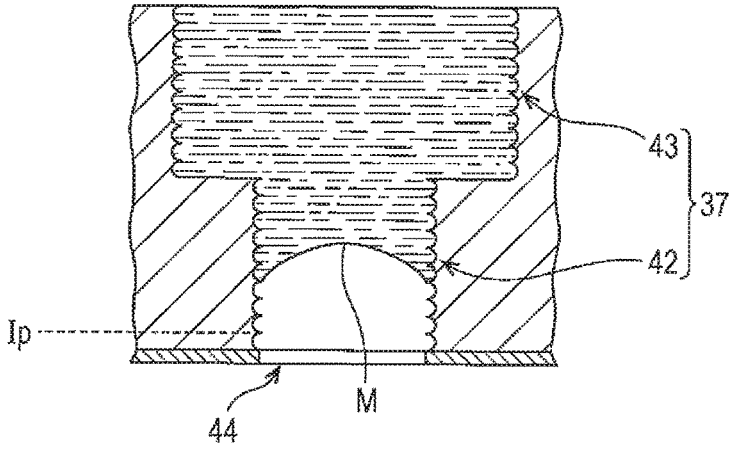
FIG. 7 is a view illustrating a process in which a liquid droplet is discharged from the nozzle.

FIGS. 6 through 9 illustrate states in which an ink droplet is discharged from the nozzle 37. FIG. 6 illustrates a state of ink in the nozzle 37 before the driving pulse Pd is applied to the piezoelectric element 20 (before ink is discharged). In this state, the reference potential VB is continuously applied to the piezoelectric element 20, and no pressure variations due to driving of the piezoelectric element 20 occur in the pressure chamber 31. Thus, a meniscus M in the nozzle 37 is retained at an initial position (reference position) indicated by a broken line Ip near the nozzle opening 44 in the drawings. In this state, when the driving pulse Pd is applied to the piezoelectric element 20, first, the expansion element p1 causes the piezoelectric element 20 to flex toward the outside of the pressure chamber 31 (to the direction away from the nozzle plate 38), and accordingly, the pressure chamber 31 expands from a reference volume corresponding to the reference potential VB to an expanded volume corresponding to the expansion potential VL. With this expansion, as illustrated in FIG. 7, the meniscus M in the nozzle 37 is drawing from the initial position Ip toward the pressure chamber 31 along an axial direction of the nozzle 37. As described above, since the potential difference Vd1 of the expansion element p1 is sufficiently smaller than the potential difference Vd2 of the contraction element p3, the amount of drawing of the meniscus by the expansion element p1 is reduced.

Figure 8:
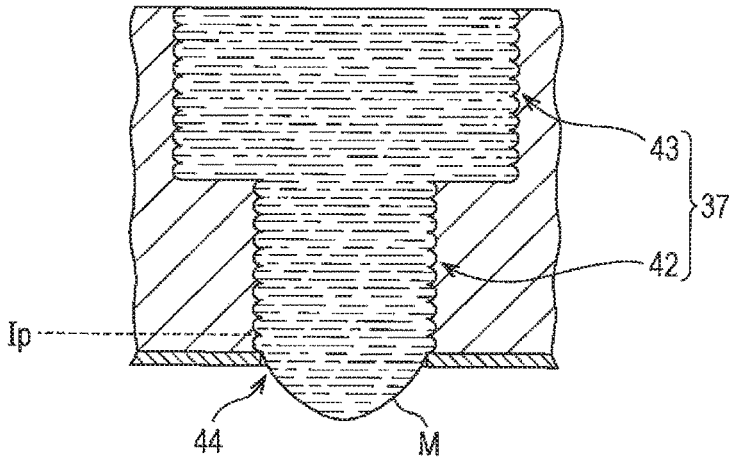
FIG. 8 is a view illustrating a process in which a liquid droplet is discharged from the nozzle.
Figure 9:
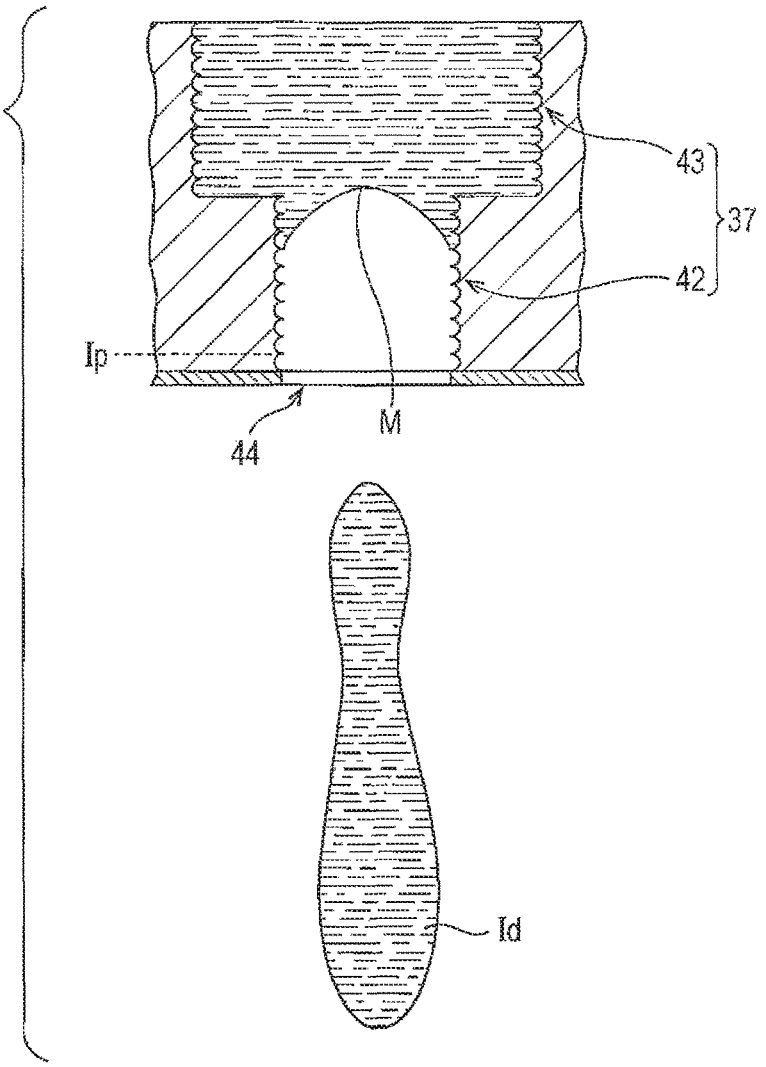
FIG. 9 is a view illustrating a process in which a liquid droplet is discharged from the nozzle.

The expanded state of the pressure chamber 31 is maintained for a certain time by the expansion hold element p2. After being held by the expansion hold element p2, the piezoelectric element 20 is caused to flex by the contraction element p3 toward the inside of the pressure chamber 31 (toward the nozzle plate 38). Accordingly, the pressure chamber 31 is rapidly contracted from the expanded volume to a contracted volume corresponding to the contraction potential VH. In this manner, as illustrated in FIG. 8, ink in the pressure chamber 31 is pressurized so that the meniscus drawn toward the pressure chamber 31 is pushed from the nozzle opening 44 to the outside of the nozzle 37 toward a discharge side opposite to the pressure chamber 31 along the axial direction of the nozzle 37 across the initial position Ip. Then, as illustrated in FIG. 9, the pushed ink is separated from ink in the nozzle 37, and flies as ink droplets Id toward a recording medium disposed below the recording head 18. The contracted state of the pressure chamber 31 is maintained during the period of supply of the contraction hold element p4. Lastly, the restore element p5 is applied to the piezoelectric element 20 so that the piezoelectric element 20 returns to a normal position corresponding to the reference potential VB. Accordingly, the pressure chamber 31 returns to a normal volume by expansion. After ink droplets Id have been discharged, the meniscus M in the nozzle 37 loses ink in an amount corresponding to the discharged ink droplets Id, and the restore element p5 causes the pressure chamber 31 to expand. Accordingly, the meniscus M greatly retreats toward the pressure chamber 31.

Figure 10:
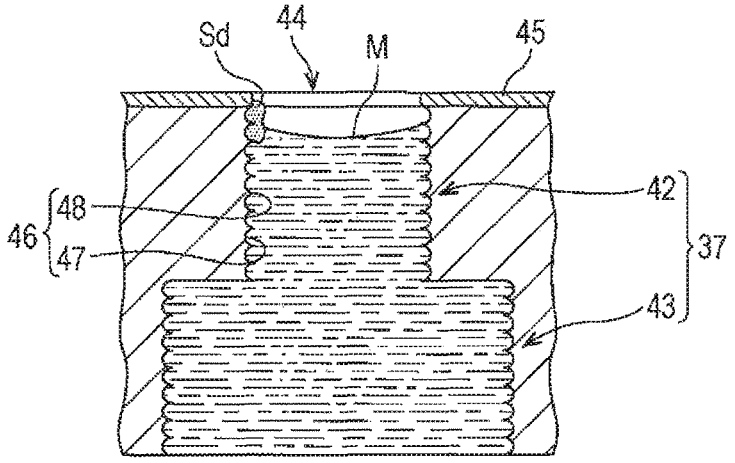
FIG. 10 illustrates a state in which sediment is attached to an inner wall surface of the nozzle.

In a configuration in which an inner wall surface has the uneven pattern 46 as in the nozzle 37 of this embodiment, ink tends to remain especially in the recess 47. When the meniscus M is drawn toward the pressure chamber 31 in discharging ink as described above, ink remaining in the recess 47 is exposed to the outdoor air. Accordingly, the viscosity of the ink gradually increases, and as illustrated in FIG. 10, sediment Sd caused by solidification of a solid component in the ink is attached to the inner wall surface of the nozzle 37. In particular, ink having a larger lower limit (yield value) necessary for flowing liquid is more likely to remain in the recess 47 and the sediment Sd is also more likely to be generated. When the sediment Sd is attached to the inner wall surface near the nozzle opening 44 of the nozzle 37, this sediment Sd causes a flying direction of ink droplets discharged from the nozzle 37 is deviated from an intended direction so that an impact position of ink on a recording medium is also shifted. This shift of the ink impact position degrades the quality of a recorded image. In particular, in a case where the flying direction is shifted toward the nozzle series (vertical alignment failure), streak-like gaps and/or overlapping (color unevenness) called banding occurs in a recorded image. Such banding is easily visually recognized in, for example, a recorded image, and the quality of the recorded image significantly degrades. Ink or sediment remaining near the nozzle opening 44 of the nozzle 37 can be removed to some degree by wiping the nozzle surface by the wiping mechanism 27. However, with this wiping, ink is likely to remain in a specific portion (e.g., a downstream portion in a wiping direction) in the nozzle opening 44, and sediment of a solid component of the remaining ink might cause flexure of the flying direction of ink droplets discharged from the nozzle 37. Regarding the uneven pattern 46 on the inner wall surface of the nozzle 37, in a configuration in which at least one recess 47 is formed, flexure of the flying direction of ink droplets caused by sediment might occur. In the printer 3 according to the invention, even in the configuration in which the inner wall surface of the nozzle 37 has the uneven pattern 46, flying flexure of ink droplets caused by the sediment Sd can be reduced so that an excellent recording image can be obtained. This will be described below.

Figure 11:
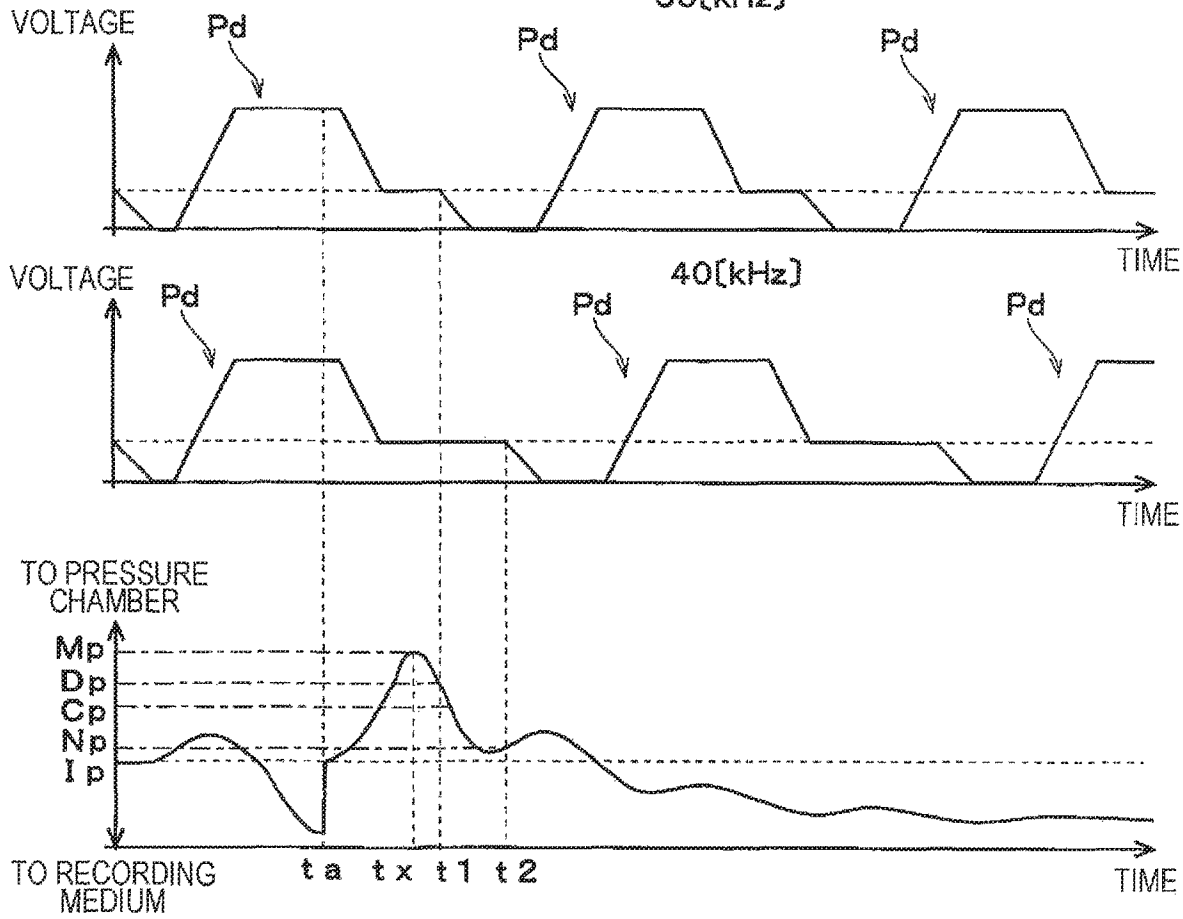
FIG. 11 shows correspondences between waveforms of driving pulses and a displacement of a meniscus in a case where a liquid droplet is discharged from the nozzle based on the driving pulse.

FIG. 11 shows correspondences between waveforms of driving pulses that are continuously generated and a displacement of a meniscus M in a case where an ink droplet is discharged from the nozzle 37 based on the driving pulses. In FIG. 11, an upper graph shows a case where a driving pulse Pd is generated with an occurrence frequency (driving frequency) of 50 [kHz], and an intermediate graph shows a case where a driving pulse Pd is generated with a driving frequency of 40 [kHz]. A lower graph shows a displacement of the meniscus M in a case where ink is discharged from the nozzle 37 based on an initial driving pulse Pd. In this graph, the upward direction is a direction to the pressure chamber 31, and the downward direction is a direction to the outside of the nozzle 37 (to the recording medium). As described above, after ink has been discharged from the nozzle 37 (at time ta), the meniscus M is greatly drawn toward the pressure chamber 31. In the lower graph, Mp is a position at which the meniscus M is most greatly drawn toward the pressure chamber 31. Thereafter, the meniscus M is gradually converged to an initial position Ip while freely vibrating. However, in continuously discharging ink from the nozzle 37 in a case where a driving pulse Pd is generated with a driving frequency of 50 [kHz] as shown in the upper graph, at time 1*t* when the meniscus M after previous discharge is located closer to a position Mp at which the meniscus M is most greatly drawn toward the pressure chamber 31 than a center position Cp between the position Mp and the initial position Ip, discharge of ink is started with a next driving pulse Pd. Accordingly, ink is repeatedly discharged while the meniscus M is drawn toward the pressure chamber 31 relative to the initial position Ip as a whole. Then, a period in which ink remaining in the inner wall of the nozzle 37 is exposed to outdoor air increases so that the sediment Sd is more likely to be generated. Consequently, flexure in the flying direction of ink droplets discharged from the nozzle 37 occurs.

In particular, in an environment of a relatively high ambient temperature or a dry environment with a relatively low humidity, the viscosity of ink tends to increase so that the problems described above are likely to arise. Thus, in the printer 3 according to this embodiment, the driving frequency of a driving pulse Pd generated by the driving signal generator 14 is changed depending on a temperature (a type of environment information) detected by the temperature sensor 40. Specifically, a threshold (e.g., 36° C.) is set for the temperature, and if the temperature detected by the temperature sensor 40 is lower than the threshold, the driving frequency of the driving pulse Pd is set at a maximum frequency (100 [%] driving frequency) in specification. On the other hand, if the temperature detected by the temperature sensor 40 is the threshold or more, the driving frequency of the driving pulse Pd is set at a frequency lower than the maximum frequency. For example, in a configuration in which the maximum frequency is 50 [kHz], the driving frequency is set at 40 [kHz], which is lower than the maximum frequency by 20 [%].

As shown in the intermediate graph in FIG. 11, in continuously discharging ink from the nozzle 37 in a case where a driving pulse Pd is generated with a driving frequency of 40 [kHz], a time (hold time) from end of previous discharge to start of subsequent discharge is extended, as compared to the case of 50 [kHz]. In this time, the meniscus M after the previous discharge moves from the position Mp at which the meniscus M is most greatly drawn toward the pressure chamber 31 toward the initial position Ip. Thereafter, at time t2 when the meniscus M is located at a position Np closer to the initial position Ip than than the center position Cp between the initial position Ip and the position Mp at which the meniscus M is most greatly drawn toward the pressure chamber 31, ink discharge starts based on a subsequent driving pulse Pd.

In this manner, if the temperature detected by the temperature sensor 40 is the threshold or more, the driving frequency of the driving pulse Pd is set at a frequency lower than the maximum frequency. Thus, even in the case of continuously discharging ink from the same nozzle 37, ink is repeatedly discharged while the meniscus M is located closer to the initial position Ip as a whole during a print operation, as compared to the case of setting the driving frequency at the maximum frequency. More specifically, subsequent (next) discharge can be performed at a time when the meniscus M is located at the position Np closer to the initial position Ip than the center position Cp between the position Mp at which the meniscus M is most greatly drawn toward the pressure chamber 31 and the initial position Ip. Accordingly, the time in which ink remaining in the inner wall of the nozzle 37 is exposed to outdoor air is reduced so that the sediment Sd is less likely to be generated near the nozzle opening 44. Consequently, flexure in the flying direction of ink droplets caused by the sediment Sd is reduced so that degradation of image quality can be suppressed. In this embodiment, since the potential difference Vd1 of the expansion element p1 of the driving pulse Pd is sufficiently smaller than the potential difference Vd2 of the contraction element p3, the amount of drawing of the meniscus M by the expansion element p1 is reduced. In this regard, this configuration contributes to suppression of generation of the sediment Sd. With a change of a driving frequency, the waveform of the driving pulse Pd may be corrected as necessary. For example, a driving voltage of the driving pulse Pd or a tilt (occurrence time) of each waveform element may be corrected. That is, the driving pulse Pd is preferably corrected so that the weight and the speed of flying of ink droplets discharged from the nozzle 37 are the same between before and after the change of the driving frequency.

It should be noted that if the driving frequency is excessively reduced to reduce the print speed, a throughput of a print operation (liquid droplet discharge operation) decreases accordingly so that a time from start to end of the print operation increases. In the nozzle 37 from which ink is not discharged in the print operation, the speed of increase in the viscosity of ink is higher than that in the nozzle 37 from which ink is frequently discharged. When the viscosity of ink in the nozzle 37 increases, in performing a discharge operation with this nozzle, ink droplets are not discharged from the nozzle or even if discharged, the weight of the discharged ink droplets decreases and/or the flying direction thereof flexes because of an increased viscosity of ink. Consequently, there arises a problem that an impact position is greatly shifted from a target position on a recording medium. In a case where the viscosity of ink has increased, the increased viscosity can be eliminated by performing a maintenance operation (cleaning operation) of forcefully sucking and discharging ink from the nozzle by using the capping mechanism 25. This cleaning operation, however, consumes a large amount of ink, and thus, the frequency of this cleaning operation needs to be as low as possible. The performance of capable of discharging ink without any problem even when the cleaning operation or ink discharge is not performed, will be hereinafter referred to as intermittent performance. From the viewpoint of suppressing reductions of throughput and intermittent performance, the driving frequency is preferably changed in an appropriate range.

FIG. 12 is a table showing quality degradation of a recorded image and an acceptance determination of intermittent performance when a driving frequency changed. Regarding image quality degradation, it was determined whether image quality degradation (banding) due to flying flexure of ink droplets occurred or not when the ink droplets were continuously discharged from the nozzle 37 with a predetermined driving frequency while the carriage 23 reciprocated for scan at 35° C. In the table, a case where no image quality degradation occurred is represented as ○, and a case where image quality degradation occurred is represented as x. The intermittent performance is determined as follows. In the case of performing a print operation with a set driving frequency, a state in which ink is not discharged from the nozzle 37 in a time (e.g., 4.5 [sec] in the case of 50 [kHz] and 5.5 [sec] in the case of 42 [kHz]) necessary for reciprocating the carriage 23 once (idle running state) was maintained at 35° C., and then the ink was discharged from the nozzle 37. At this time, if the amount of shift of a target impact position from an actual impact position on a recording medium was within a predetermined range (e.g., 60 [μm] or less), the result is marked as ○, and otherwise, the result is marked as x. Alternatively, in a case where the idle state was maintained at 40° C. and then discharge from the nozzle 37 was initially performed, if ink droplets were discharged from the nozzle to impact on the recording medium, the result may be marked as ○, and if ink droplets were not discharged from the nozzle 37 and did not impact on the recording medium, the result may be marked as x.

From the table in FIG. 12, in an environment of 35° C., in cases where the driving frequency was 44 [kHz] or more, image quality degradation due to flexure in the flying direction of ink droplets caused by sediment in the nozzle 37 occurred, and all the results were x. On the other hand, in cases where the driving frequency was 42 [kHz] or less, image quality degradation (banding) due to flexure in the flying direction of ink droplets caused by sediment in the nozzle was not observed, and all the results were ○. Regarding intermittent performance, as the driving frequency increased, the intermittent performance became more and more excellent, and if the driving frequency was 38 [kHz] or more, the result was ○. On the other hand, if the driving frequency was 36 [kHz] or less, the idling time was extended accordingly. Thus, ink droplets were not discharged from the nozzle 37, or even if discharged, an impact positional shift on the recording medium significantly increased, and the result was x. Thus, to change the driving frequency, the driving frequency is preferably set in the range from 38 [kHz] or more and 42 [kHz] or less. In this manner, a significant decrease in throughput of a print operation due to a decrease of the driving frequency can be suppressed while image quality degradation due to flexure in the flying direction of ink droplets caused by sediment in the nozzle 37 can be suppressed. In addition, a discharge failure of ink droplets due to an increased viscosity of ink in the nozzle 37 during the print operation can be suppressed. When the environment temperature decreases below the threshold, the driving frequency is increased accordingly. That is, in this embodiment, when the temperature detected by the temperature sensor 40 is 35° C. or less, the driving frequency is returned to 50 [kHz].

Other embodiments of the invention will now be described.

Figure 13:
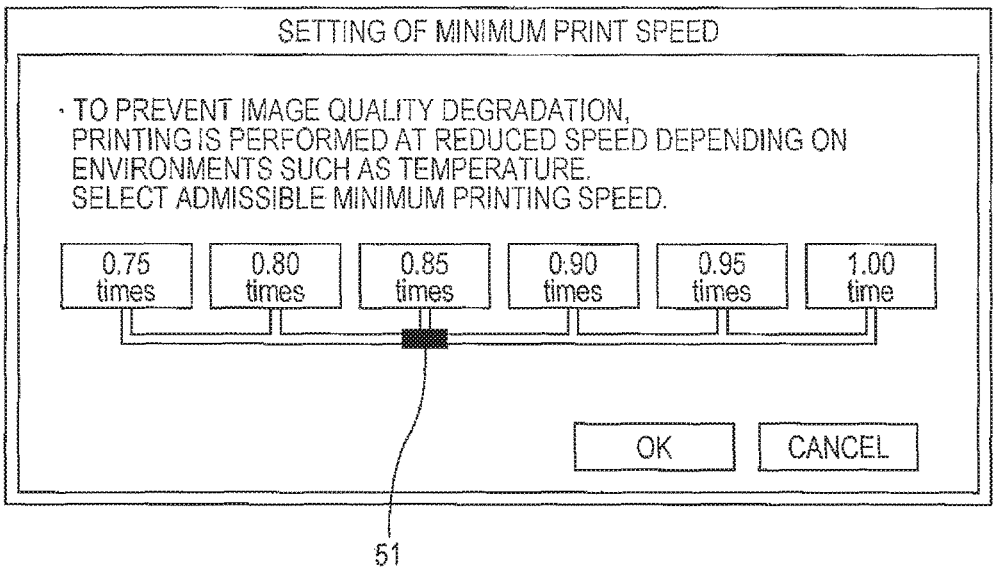
FIG. 13 illustrates an example of a GUI in a second embodiment.
Figure 14:
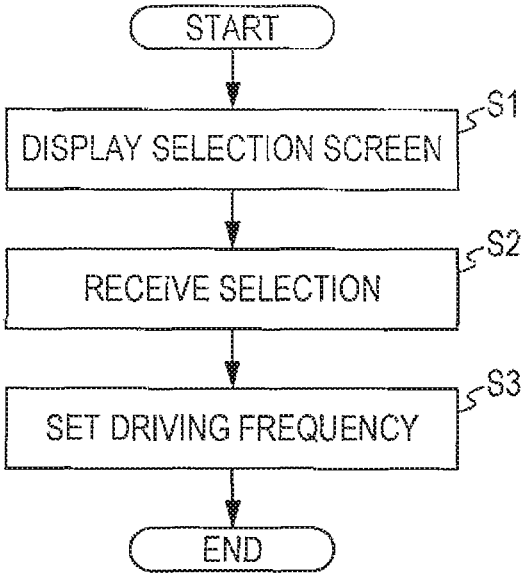
FIG. 14 is a flowchart showing a flow of a process of a device driver.

FIG. 13 illustrates an example of display of a GUI for selecting a print mode in a second embodiment. FIG. 14 is flowchart showing a flow of a process of the device driver 9. In the configuration described in the first embodiment, if the temperature detected by the temperature sensor 40 is the threshold or more, the driving frequency is changed independently of an intension of a user. The invention, however, is not limited to this configuration. Since it may be possible that some users want to place priority on print speed over image quality, a user may select a permissible degree of reduction of the print speed (reduction of the driving frequency). For example, the printer driver 9 causes an unillustrated image display device connected to the computer 1 to display a GUI as illustrated in FIG. 13 (selection screen display step S1). The GUI shows examples of options of selection of the lower limit of the print speed (lower limit of the driving frequency), such as 0.75 times, 0.80 times, 0.85 times, 0.90 times, 0.95 times, and 1.00 time so that the user can select the lower limit of permissible minimum print speed by operating a slider 51 through an input device such as a mouse. Since the print speed corresponds to the driving frequency in this case, selection of the print speed involves indirect selection of the minimum driving frequency.

For example, in a case where the user selects a print speed (with a driving frequency of 42.5 [kHz]) 0.85 times as high as a maximum print speed (i.e., print speed with a driving frequency of 50 [kHz] in the example above), the user positions the slider 51 under this option (i.e., 0.85 times). When the printer driver 9 receives the option selected by the user (selection receiving step S2), selection information indicating which lower limit was selected by the user is then transmitted to the CPU 11 of the printer 3. In response to this, the printer 3 sets a driving frequency based on the selection information (frequency setting step S3). Specifically, the printer driver 9 indirectly reflects the selection information on setting of the driving frequency. In this manner, in the printer 3, even in a situation where the print speed is preferably lower than 0.85 times based on the temperature detected by the temperature sensor 40, a print operation is performed without reduction of the print speed to a degree below 0.85 times as the lower limit. In another case, if the user selects 1.00 time, a print operation is performed at a maximum print speed, independently of an environment temperature. In this manner, the user selects the lower limit of the print speed (driving frequency) so that a print operation satisfying the needs of the user can be performed. The series of processes of the printer driver 9 described above may be performed by the CPU 11 of the printer 3. Specifically, the CPU 11 causes the display device 41 provided in the body of the printer 3 to display a similar GUI, receives selection of a lower limit of the driving frequency by a user through the GUI, and reflects the lower limit on setting of a driving frequency of a driving pulse Pd by the driving signal generator 14. The other part of the configuration is similar to that of the first embodiment.

Figure 15:
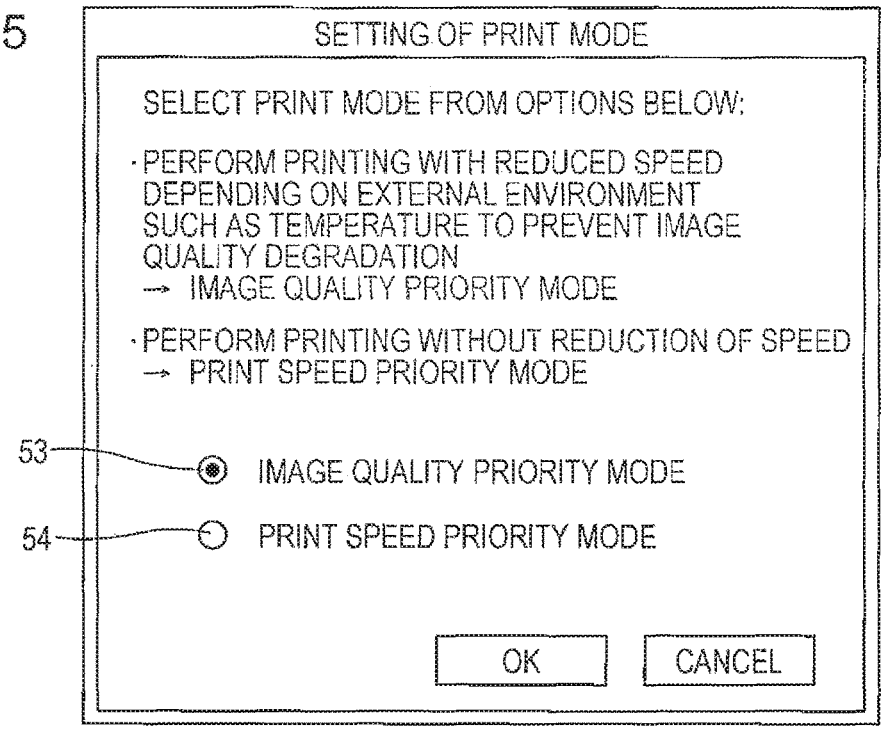
FIG. 15 illustrates an example of a GUI in a third embodiment.

FIG. 15 illustrates an example of a GUI for setting a print mode in a third embodiment. In this embodiment, two print modes: a first mode (image quality priority mode) in which a print operation is performed with a print speed reduced depending on an environment temperature in order to prevent image quality degradation (degradation of recording quality) and a second mode (print speed priority mode) in which a print operation is performed at a maximum print speed independently of the environment temperature without reduction of the print speed may be set. A user may select one of these modes in a flow similar to that shown in FIG. 14. For example, in a manner similar to the second embodiment, the printer driver 9 causes an image display device, for example, to display a GUI as illustrated in FIG. 14 (selection screen display step S1). The GUI shows a radio button 53 for selecting the first mode and a radio button 54 for selecting the second mode. A user selects one of the radio buttons 53 and 54 through an input device such as a mouse for instruction, thereby selecting an intended pint mode. For example, in the case of selecting the first mode in which priority is placed on image quality, the corresponding radio button 53 is selected and checked (marked as ●). When the printer driver 9 receives mode selection by the user (selection receiving step S2), the printer driver 9 transmits selection information indicating the mode selected by the user to the CPU 11 of the printer 3, and a driving frequency is set based on the selection information in the printer 3 (frequency setting step S3). That is, in a case where the first mode is selected, a print operation is performed with the print speed reduced (the driving frequency reduced) depending on the temperature detected by the temperature sensor 40 in the printer 3. On the other hand, in a case where the second mode is selected, a print operation is performed at a maximum print speed (maximum driving frequency) independently of an environment temperature. In the configuration of this embodiment, the user can easily and intuitively select and set a mode depending on whether priority is placed on image quality or print speed. The mode is not necessarily selected by using radio buttons but also may be selected by a slide bar. In this case, an intermediate mode between the first mode and the second mode can be selected, for example. In this intermediate mode, the driving frequency is changed depending on the temperature detected by the temperature sensor 40. Alternatively, the frequency of change of the driving frequency may be changed depending on the position of the slide bar. The other part of the configuration is similar to that of the first embodiment.

Figure 16:
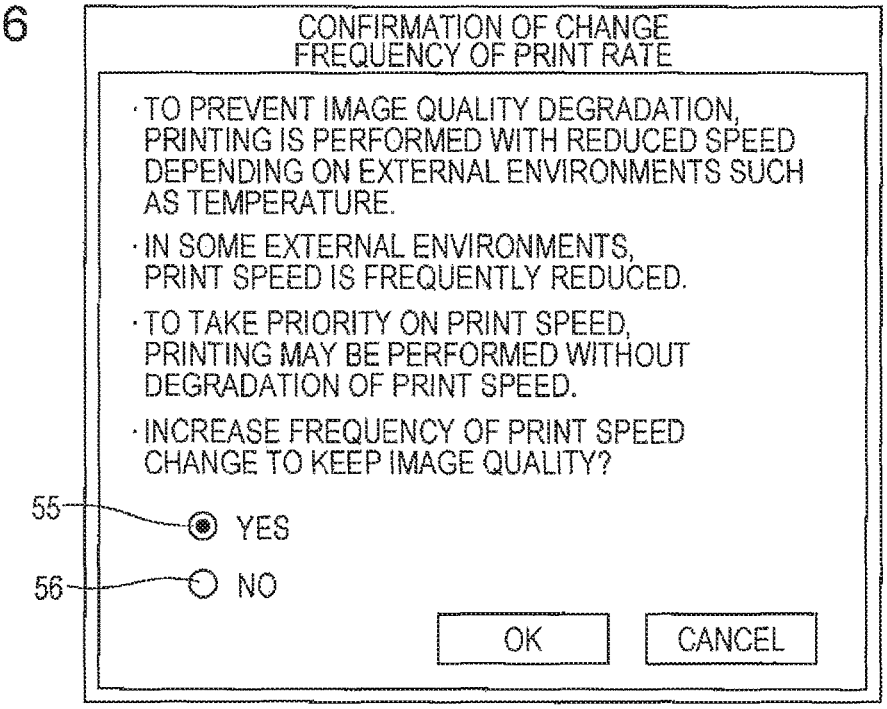
FIG. 16 illustrates an example of a GUI in a fourth embodiment.

FIG. 16 illustrates an example of display of a GUI for confirming change frequency of a print speed in a fourth embodiment. In this embodiment, the driving frequency (print speed) is regularly changed at each time when a predetermined number of paths (a scanning unit of the recording head 18) or when a predetermined time has elapsed, for example. The frequency of change of the driving frequency is changed depending on the environment temperature. Specifically, until the temperature detected by the temperature sensor 40 reaches a minimum one of thresholds of temperature, a print operation is performed with the driving frequency being set at a maximum frequency. If the detected temperature is at the minimum, the frequency of change is set at every several tens of paths, for example, and the driving frequency is changed with this frequency. In addition, if the detected temperature is the second lowest value among the thresholds, the frequency of change is set at every several paths, for example, and the driving frequency is changed with this frequency. Of course, if the environment temperature becomes lower than the threshold, the driving frequency is changed to a larger value accordingly, and the frequency of change is also set at a lower level.

As described above, based on the premise that the driving frequency (print speed) is changed regularly, a user may select whether to permit an increase in the frequency of change of the driving frequency (print speed) or not. For example, in a manner similar to the second or third embodiment, the printer driver 9 causes an image display device, for example, to display a GUI as illustrated in FIG. 16. The GUI shows a radio button 55 (yes) for permitting an increase in the frequency of change of the driving frequency (print speed) and a radio button 56 (no) for prohibiting an increase in the frequency of change of the driving frequency (print speed). A user selects one of the radio buttons 55 and 56 for instruction through an input device such as a mouse, thereby selecting whether to permit an increase in the frequency of change of the driving frequency (print speed) or not. In the case of permitting an increase in the frequency of change, for example, the corresponding radio button 55 is selected and checked (marked as ●). If an increase in the frequency of change is permitted, the printer 3 regularly changes the print speed while changing the frequency of change depending on the temperature detected by the temperature sensor 40 as described above, thereby performing a print operation. On the other hand, if an increase in the frequency of change is prohibited, a print operation is performed at a maximum print speed, independently of the environment temperature.

The environment information is not limited temperatures, and humidities may be employed. In this case, a threshold is set for a value detected by a humidity sensor in a manner similar to that in the case of temperatures. If the detected temperature is the threshold or less, the viscosity of ink is likely to increase and sediment is likely to be generated. Thus, control is performed to reduce the driving frequency. In this manner, generation of sediment in the nozzle is reduced under low humidity (under a dry environment), and flexure in the flying direction of ink droplets caused by the sediment is reduced so that image quality degradation is suppressed.

The driving pulse Pd is not limited to the examples illustrated in FIGS. 5 and 11, and various known driving pulses used for discharging liquid droplets by driving a driver element may be employed.

In addition, in the above embodiments, the so-called flexural vibration piezoelectric element 20 is employed as an example of a driver element. Alternatively, a so-called vertical vibration piezoelectric element may be employed. In this case, the driving pulse Pd described in the above embodiment as an example has a waveform with a reversed direction of potential change, that is, a reversed vertical direction (polarity).

The invention is not limited to the printer 3 described above and is also applicable to various types of ink jet recording apparatuses such as a plotter, a facsimile machine, and a copying machine or liquid droplet discharge devices such as a textile printing device that causes ink to impact from a liquid discharge head onto fabric (textile printing target) that is a type of an impact target, as long as these devices are liquid discharge devices each having an uneven pattern on an inner wall surface of a nozzle. The invention is also applicable to a device driver for these devices.

The entire disclosure of Japanese Patent Application No. 2016-036139, filed Jan. 26, 2016 is expressly incorporated by reference herein.

What is claimed is:

1. A liquid discharge device comprising a liquid discharge head that includes a nozzle from which liquid is discharged, the liquid discharge head including a liquid channel communicating with the nozzle;

a driver that causes a pressure vibration of the liquid in the liquid channel and that causes the liquid to be discharged from the nozzle;

a driving pulse generator that generates a driving pulse for driving the driver so that the driver causes the pressure vibration of the liquid and causes the liquid to be discharged from the nozzle;

a memory that stores computer-readable instructions; and a processor configured to execute the computer-readable instructions so as to control the driving pulse generator, wherein the nozzle has an inner wall surface having one or more annular recesses each of which extends along a circumference of the nozzle, and the annular recesses are arranged along a center axis of the nozzle so that the inner wall surface has an uneven pattern, the processor is configured to:

maintain an initial state in which the liquid is retained inside of the nozzle at an initial position;

perform first control so as to control the driving pulse generator to cause the liquid to be discharged from the nozzle at a first timing, and after ejecting the liquid, a meniscus is formed closest to the liquid channel at a first position; and perform second control so as to control the driving pulse generator to cause the liquid to be discharged from the nozzle at a second timing after the first control, and wherein the processor is configured to perform the second control when a downstream edge of the liquid is located at a second position, the second position is closer to the initial position than a middle position between the initial position and the first position.

2. The liquid discharge device according to claim 1, further comprising:

a detection mechanism that detects environment information, wherein the processor controls the driving pulse generator so as to reduce a frequency of the driving pulse depending on the detected environment information detected by the detection mechanism.

3. The liquid discharge device according to claim 2, wherein the environment information is a temperature, when the temperature detected by the detection mechanism is lower than a predetermined threshold, the processor controls the driving pulse generator so as to set the frequency of the driving pulse at a first frequency, and when the temperature detected by the detection mechanism is equal to or more than the predetermined threshold, the processor controls the driving pulse generator so as to set the frequency of the driving pulse lower than the first frequency.

4. The liquid discharge device according to claim 3, wherein the first frequency is a maximum frequency for the driving pulse.

5. The liquid discharge device according to claim 2, wherein the environment information is humidity, when the humidity detected by the detection mechanism is higher than a predetermined threshold, the processor controls the driving pulse generator so as to set the frequency of the driving pulse at a first frequency, and when the humidity detected by the detection mechanism is equal to or more than the predetermined threshold, the processor controls the driving pulse generator so as to set the frequency of the driving pulse lower than the first frequency.

6. The liquid discharge device according to claim 5, wherein the first frequency is a maximum frequency for the driving pulse.

7. The liquid discharge device according to claim 2, wherein the processor controls the driving pulse generator so as to change the frequency of the driving pulse to a range of 38 [kHz] to 42 [kHz].

8. The liquid discharge device according to claim 2, further comprising:

a display displaying a selection screen for a user, wherein the processor is configured to cause the display to display the selection screen for indicating the user to select a lower limit of the frequency of the driving pulse, and the processor is configured to cause the display to receive selection by the user through the selection screen, and the processor controls the driving pulse generator so as to change the frequency in a range not lower than the lower limit selected by the user.

9. A method for controlling the liquid discharge device according to claim 8, the method comprising:

a selection screen display step of causing the display to display the selection screen;

a selection receiving step of receiving the selection by the user through the selection screen; and a frequency setting step of setting the frequency of the driving pulse based on the selection by the user.

10. A device driver capable of being executed by an information processor connected to a liquid discharge device so that the information processor and the liquid discharge device communicate with each other, wherein the device driver performs the steps of the method for controlling the liquid discharge device according to claim 9.

11. The liquid discharge device according to claim 2, further comprising:

a display displaying a selection screen for a user, the processor is configured to cause the display to display the selection screen for enabling the user to select one of a first mode and a second mode, a first liquid droplet discharge operation is performed with the frequency of the driving pulse reduced depending on the environment information in the first mode, and a second liquid droplet discharge operation is performed with the frequency of the driving pulse unchanged in the second mode, the processor is configured to cause the display to receive selection by the user through the selection screen, and the processor controls the driving pulse generator so as to set the frequency of the driving pulse based on the selection by the user.

12. A method for controlling the liquid discharge device according to claim 11, the method comprising:

a selection screen display step of causing the display to display the selection screen;

a selection receiving step of receiving the selection by the user through the selection screen; and a frequency setting step of setting the frequency of the driving pulse based on the selection by the user.

13. A device driver capable of being executed by an information processor connected to a liquid discharge device so that the information processor and the liquid discharge device communicate with each other, wherein the device driver performs the steps of the method for controlling the liquid discharge device according to claim 12.

* * * * *